US006066839A

United States Patent [19]

Park

[11] Patent Number: 6,066,839

[45] Date of Patent: May 23, 2000

[54] TEMPERATURE COMPENSATION METHOD FOR A MICROWAVE OVEN

[75] Inventor: Won Kyung Park, Changwon, Rep. of Korea

[73] Assignee: LG Electronics Inc., Seoul, Rep. of Korea

[21] Appl. No.: 09/191,346

[22] Filed: Nov. 13, 1998

[30] Foreign Application Priority Data

Nov. 14, 1997 [KR] Rep. of Korea ..... 97-60143

[51] Int. Cl.[7] ..... H05B 6/68

[52] U.S. Cl. ..... 219/710; 219/711; 219/719; 374/149; 99/325

[58] Field of Search ..... 219/711, 710, 219/719, 492; 99/325; 374/149, 120, 121, 126

[56] References Cited

U.S. PATENT DOCUMENTS 4,499,357 2/1985 Kojima ..... 219/711

4,553,011 11/1985 Nakata et al. ..... 219/711

FOREIGN PATENT DOCUMENTS 63-38825 2/1988 Japan ..... 219/711

63-49635 3/1988 Japan ..... 219/711

63-201430 8/1988 Japan ..... 219/711

*Primary Examiner*—Philip H. Leung

[57] ABSTRACT

A temperature compensation method for a microwave oven, and more particularly a method capable of compensating for a detected temperature error of a food which is caused by electromagnetic wave noise when a heating operation of microwave oven is controlled by an infrared sensor. The method includes a first step of comparing a detected temperature with a predetermined cooking temperature, a second step of halting the heating operation when the detected temperature is higher than the cooking temperature, a third step of comparing a real detected temperature of the food with the cooking temperature as heating operation is stopped, and a fourth step of compensating the real temperature of the food by resuming the heating operation when the real temperature of food is lower than the cooking temperature.

8 Claims, 5 Drawing Sheets

TEMPERATURE COMPENSATION METHOD FOR A MICROWAVE OVEN

BACKGROUND OF THE INVENTION

1. Field of the Invention

The present invention relates to a temperature compensation method for a microwave oven, and more particularly to a method capable of compensating for a detected temperature error of a food which is caused by electromagnetic wave noise when a heating operation of a microwave oven is controlled by an infrared sensor.

2. Description of the Prior Art

A conventional microwave oven (hereinafter "MWO") finishes cooking by stopping a heating operation when a detected temperature from an infrared sensor reaches a cooking temperature after the heating operation starts. However, it is difficult to discriminate whether the temperature detected from the infrared sensor is the correct temperature of the food or a temperature caused by electromagnetic wave noise. Therefore, in a conventional MWO, at the moment the temperature detected from the infrared sensor reaches cooking temperature, cooking is stopped immediately; thus, the food may not be sufficiently cooked to a desired level.

FIG. 1 illustrates a block diagram showing a hardware system of a MWO in general.

The MWO comprises an opening 4 at the upper part of a cooking chamber 1 and an infrared sensor 5 for detecting the temperature of a food 7 placed in the cooking chamber 1 through the opening 4. Also, the MWO comprises a heating part 3 for generating a microwave based on the temperature detected from the infrared sensor 5. The MWO also includes a controlling part 6 for controlling the overall operation of the system.

Moreover, a turntable driving motor 8 being controlled by the controlling part 6 is installed at the lower part of the cooking chamber 1. A turntable 2 is installed inside of the cooking chamber 1. The turntable 2 is rotated turned by the rotation of the motor 8 mounted at the upper part of the motor 8 axis. Cooking stuff 8 is placed thereon.

The controlling part 6 controls the heating part 3 and the driving of motor 8 after a heating start key is operated. As shown in FIG. 2, the controlling part 6 comprises:

A key inputting part 6*a* for predetermining the cooking temperature suitable for a desired food, or inputting the heating start signal; a predetermined temperature storing part 6*b* for storing the predetermined cooking temperature; a detected temperature storing part 6*c* for temporarily storing the temperature detected from the infrared sensor 5; a displaying part 6*d* for displaying a simple message, i.e. the predetermined temperature and the detected temperature with liquid crystal display; and a output controlling part 6*e* for controlling the output by comparing the predetermined temperature with the detected temperature.

That is, the controlling part 6 disseminates the detected temperature by a signal detected from the sensor 5, and then operates the heating part 3 to the extent that the detected temperature approaches the predetermined temperature and controls the heating part 3 until cooking is completed.

Food 7 is heated by a microwave emitted from the heating part 3. The turntable 2 rotates such that the emitted microwave evenly impinges the food 7 when the heating part is operated.

The control operation of the conventional MWO including the above system is described in detail as follows.

The user puts food 7 on the turntable 2, predetermines a proper cooking temperature through the key inputting part 6*a*, and accuates the heating start key. The predetermined cooking temperature is stored in the predetermined temperature storing part 6*b*.

The output controlling part 6*e*, as the heating start key is accuated, operates the heating part 3 and the turntable driving motor 8. Simulataneously, a microwave is emitted from the heating part 3 in order to heat the food 7. As the heating part 3 is operated continually, the temperature of food 7 rises.

The infrared sensor 5 detects through an opening 4 the food temperature placed in the cooking chamber 1. The detected temperature is temporarily stored in the detected temperature storing part 6*c*.

The output controlling part 6*e* reads the temperatures stored in the detected temperature storing part 6*c* and the cooking temperature stored in the predetermined temperature storing part 6*b*, and compares both of them. Then, the output controlling part 6*e* heats food 7 by continuously operating the heating part 3 to the degree that the detected temperature comes up to the cooking temperature. As the temperature detected from the sensor 5 reaches the cooking temperature, the output controlling part 6*e* stops the operation of the heating part 3.

Therefore, the automatic cooking controlling method for a conventional MWO completes a cooking operation when the predetermined cooking temperature is detected through the sensor 5.

According to the temperature controlling method for the conventional MWO, there is a slight difference between the detected temperature value of food detected from the sensor 5 and the real temperature value of food. This is caused by high frequency while the heating part oscillates. That is, the detected value of the infrared sensor 5 does not coincide with the value of predetermined cooking temperature due to high frequency, generated by an oscillation of the heating part 3. As a result, the conventional control method for the conventional MWO fails to accurately cook a food to a predetermined temperature due to the above-discussed disadvantages.

SUMMARY OF THE INVENTION

The object of the present invention is to provide a method capable of compensating for a detected temperature error of a food caused by electromagnetic wave noise when a heating operation of a microwave oven is controlled by an infrared sensor.

To achieve the above object, the method of the present invention comprises the steps of: comparing a detected temperature with a predetermined cooking temperature; stopping heating operation as the detected temperature is higher than the cooking temperature; comparing a real detected temperature of a food with the cooking temperature as heating operation is stopped; and compensating for the real temperature of food by resuming heating operation when the real temperature of food is lower than the cooking temperature.

And, stopping heating operation after the second step is performed, if a current time is smaller than that of a predetermined cooking time.

Also, detecting of the real temperature of the food for the temperature compensation is performed during one rotating cycle of the turntable.

Additionally, detecting the real temperature of the food for temperature compensation is predetermined as the maximum value of the temperature detected during a revolution of the turntable.

Moreover, compensating for the real temperature of food is performed by adding the temperature gained in proportion to a re-heating time to the detected real temperature of food. This is repeated until the added temperature reaches the predetermined cooking temperature.

That is, the present invention has advantages which reduce the error of a detected temperature caused by an electromagnetic wave noise which is likely to occur in cooking a small quantity of food.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The characteristics and advantage of the present invention will become more apparent by describing the preferred embodiments thereof with reference to the accompanying drawings, in which.

DETAILED DESCRIPTION OF THE PREFERRED EMBODIMENT

Figure 1:
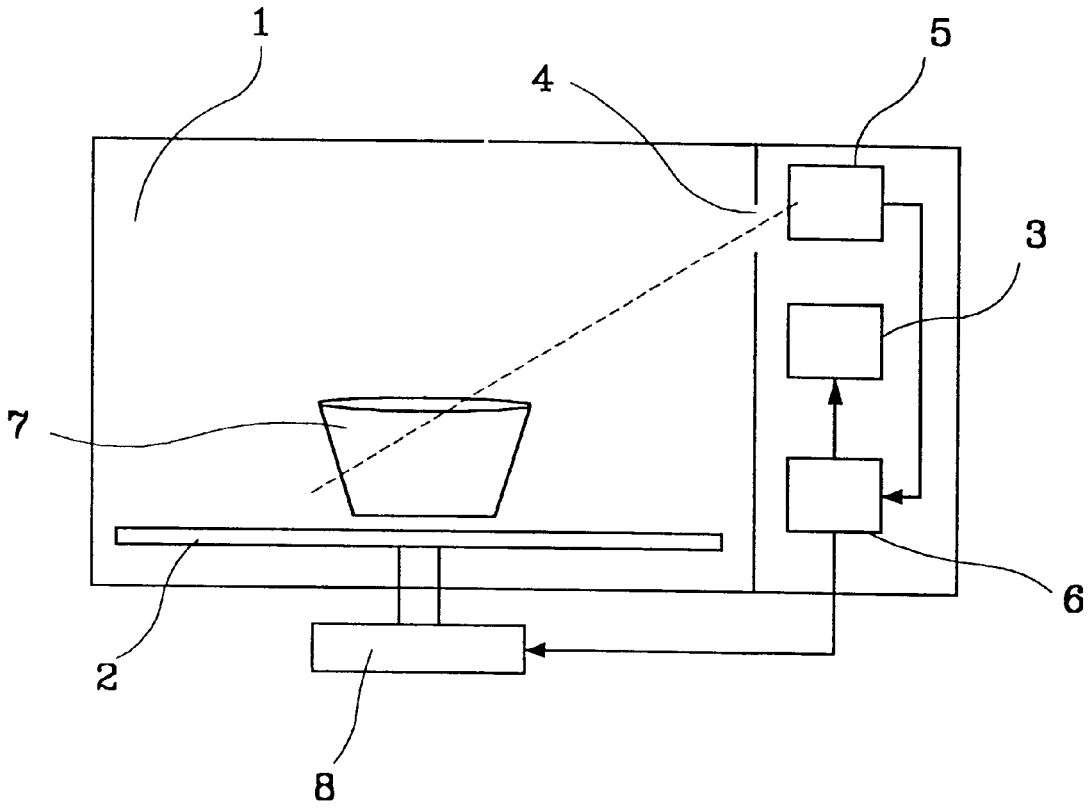
FIG. 1 CONVENTIONAL ART
FIG. 1 illustrates a hardware block diagram for a whole system of a conventional MWO.
Figure 2:
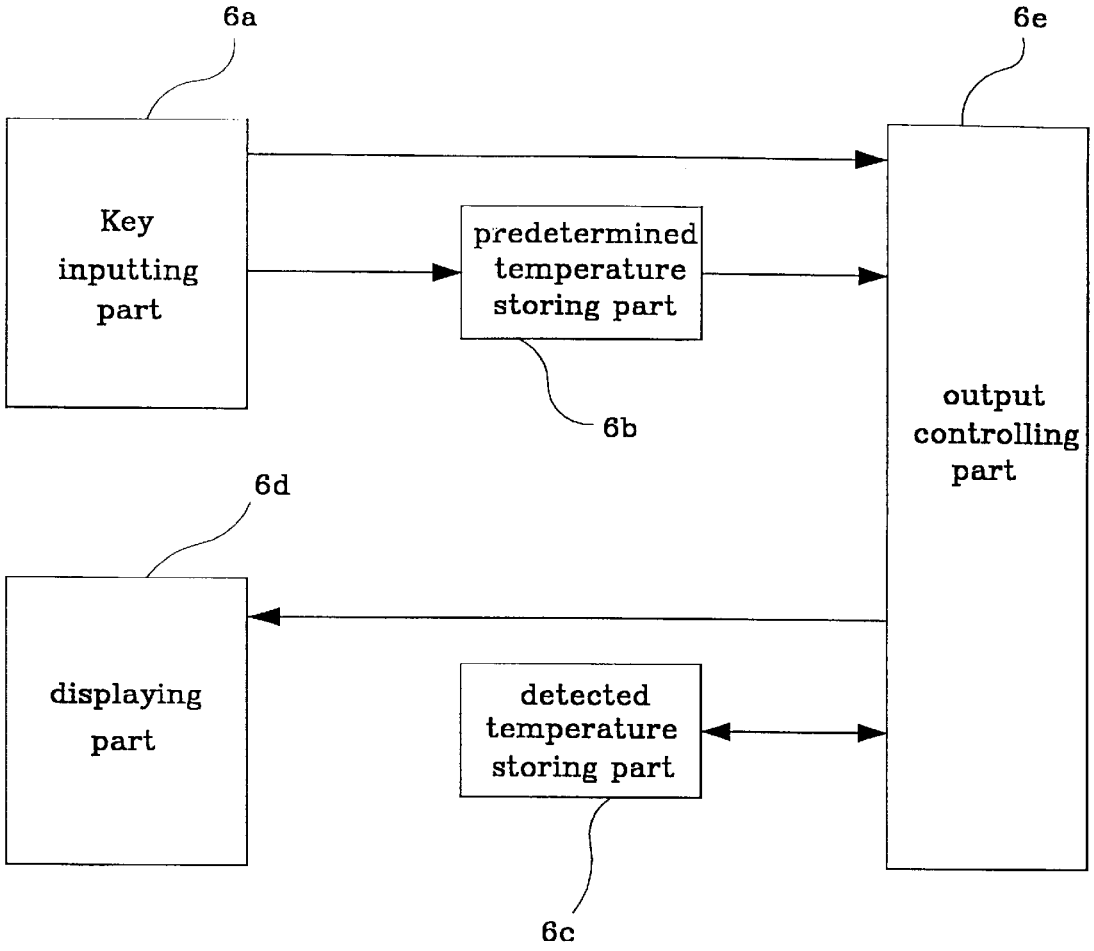
FIG. 2 CONVENTIONAL ART
FIG. 2 illustrates a detailed block diagram of the controlling part in FIG. 1 for a conventional automatic cooking control.
Figure 3:
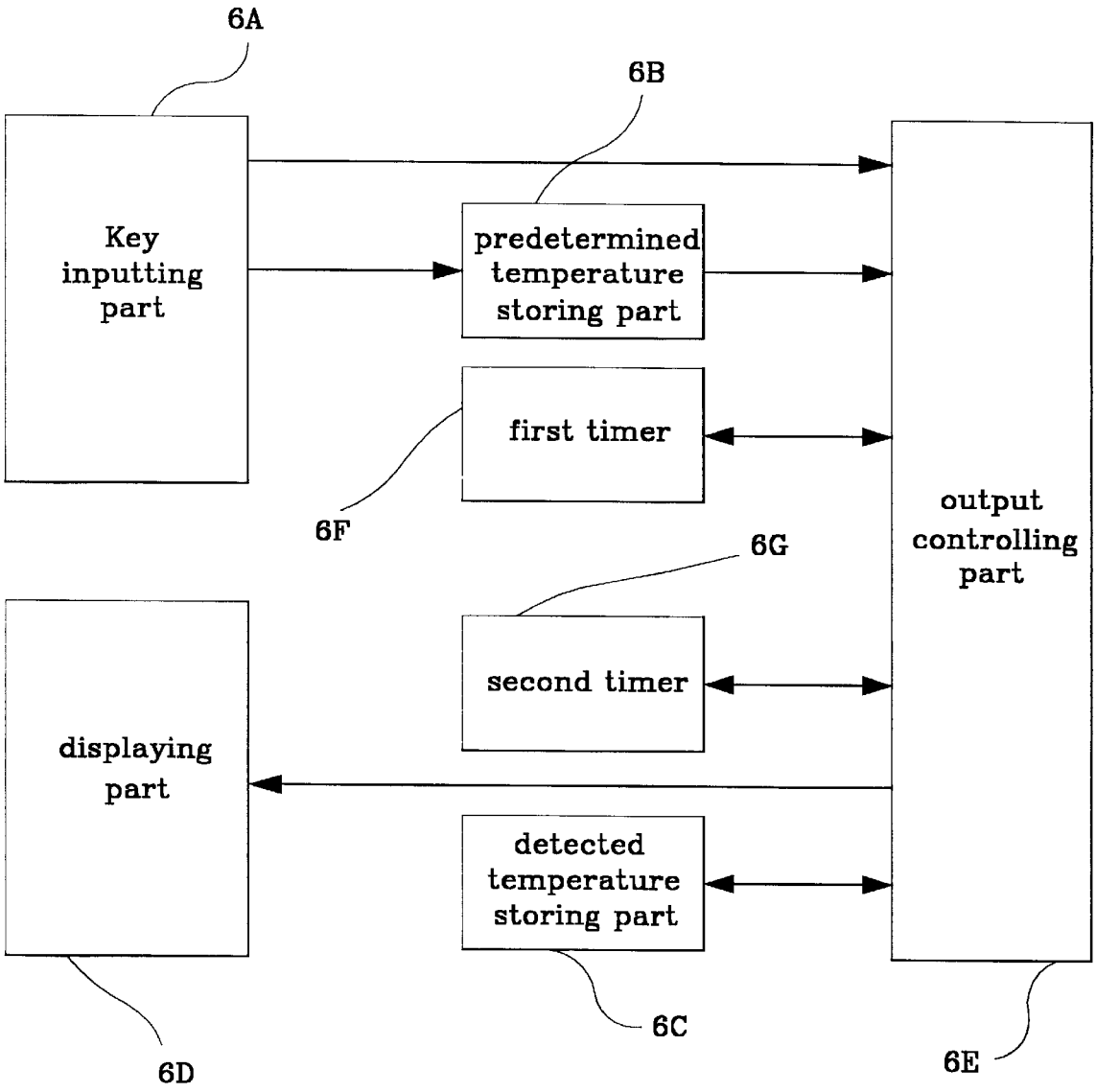
FIG. 3 illustrates a detailed block diagram of the controlling part in FIG. 1 for compensating a cooking temperature according to the present invention.

According to FIG. 1, the present invention comprises a turntable 2 located in the center of a cooking chamber 1, a heating part 3 for generating a microwave to heat food 7, a temperature sensor 5 of the non-contacting type, such as a thermopile sensor for detecting a temperature of the food 7 through an opening 4 placed in the upper part of the cooking chamber 1 and a controlling part 6 for controlling all the operations of each of parts disclosed above. According to FIG. 3, the controlling part 6 comprises: a key inputting part 6A for predetermining a cooking temperature appropriate for a desired cooking level, and accuating a heating start key; a predetermined temperature storing part 6B for storing a predetermined cooking temperature; a detected temperature storing part 6C for storing the temperature detected from the sensor 5, and a displaying part 6D for displaying the predetermined cooking temperature or the detected temperature, etc. Also, the controlling part 6 comprises an output controlling part 6E for controlling the operation of the heating part 3 by comparing the cooking temperature with the detected temperature; a first timer 6F for maintaining a cooking time, and a second timer 6G for counting a rotation cycle of the turntable 2.

That is, the temperature control of the present invention disseminates whether the temperature detected from the sensor 5 reaches the real temperature of the food or not.

In case the temperature detected from the sensor 5 reaches the predetermined cooking temperature even when the real temperature of the food 7 does not reach the cooking temperature, the detected temperature is re-calculated. In other words, the detected temperature is calculated by adding the value gained in proportion to the re-heating time of the heating part 3 to the maximum value of real temperature of food 7 and determines whether the calculated temperature reaches the predetermined cooking temperature or not.

Figure 4:
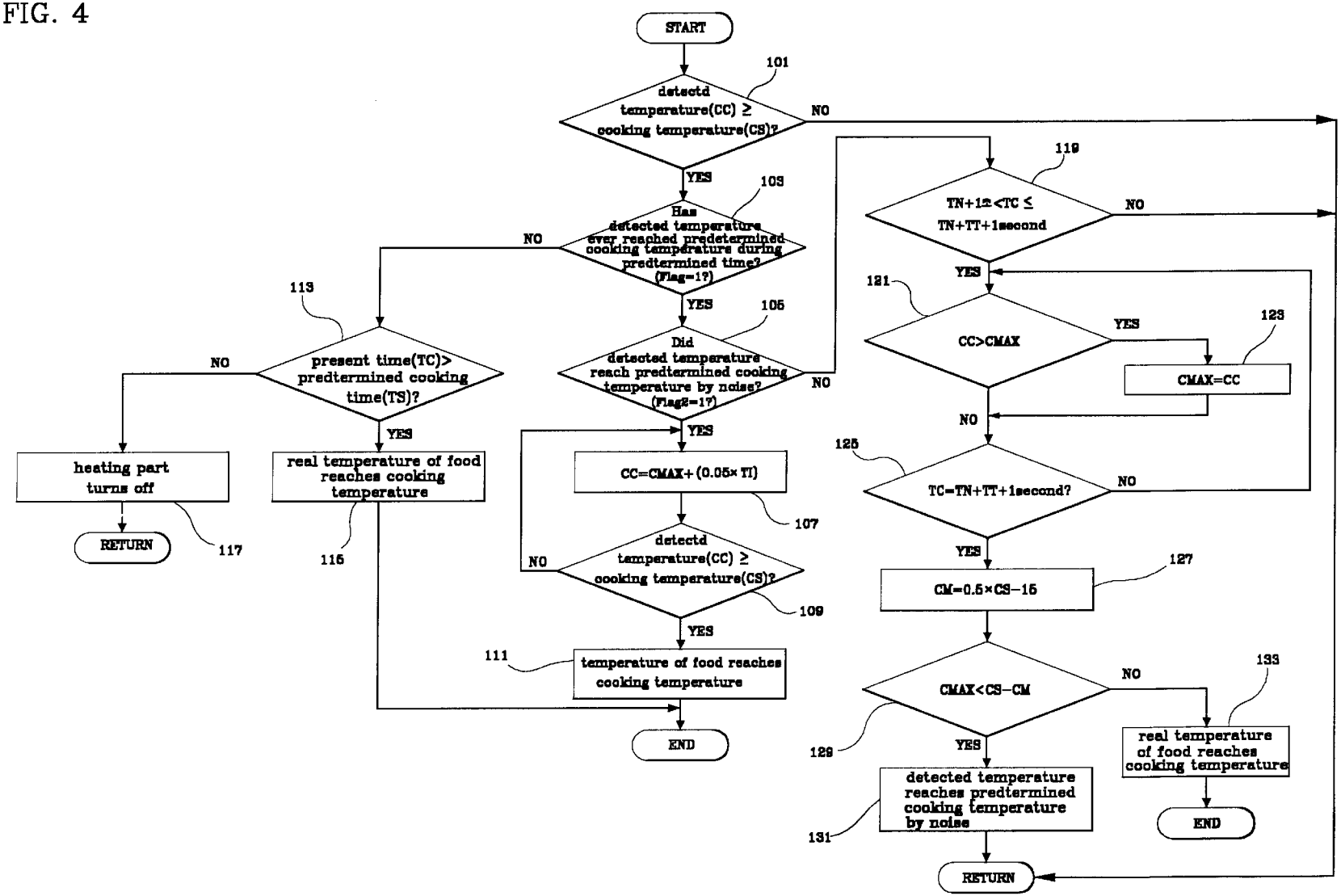
FIG. 4 illustrates a flowchart showing the method for compensating a cooking temperature according to the present invention.

Related to FIG. 4, the temperature compensation method of the present invention is described below.

The user puts the food 7 on the turntable 2 in the cooking chamber 1, and selects the heating start key through the key inputting part 6A. The output controlling part 6E, when the heating start key is input, operates the driving motor 8 for the turntable 2 and the heating part 3. The heating part 3 generates a microwave and increases the temperature of the food 7 in the cooking chamber 1. The turntable 2 is rotated by motor 8. A cooking temperature CS may be set through the key inputting part 6A by a user before the heating start key is accuated. The predetermined cooking temperature CS is stored in the predetermined temperature storing part 6B. The cooking temperature CS can be set directly by the user or the cooking temperature CS may already be stored in the predetermined temperature storing part 6B. This occurs during an auto cooking mode wherein the cooking temperature CS is automatically selected. Regardless, the output controlling part 6E recognizes the cooking temperature CS.

Likewise, a cooking time TS can be set directly by the user through the key inputting part 6A before the heating start key is inputted, or the predetermined cooking time TS may be read by the output controlling part 6E if the auto cooking mode is being used.

In this way, the output controlling part 6E recognizes the cooking temperature CS and the cooking time TS, and controls the operation of the heating part 3. During a cooking operation, a first timer 6F counts the accumulated cooking time under the control of the output controlling part 6E.

During the cooking process, the temperature of the food 7 is increased gradually, in relation to the oscillating operation of the heating part 3. The infrared sensor 5 concurently detects the temperature of the food 7 through the opening 4, this detected temperature is temporarily stored in the detected temperature storing part 6C.

The output controlling part 6E continually reads the detected temperature CC, which is stored in the detected temperature storing part 6C. The heating part 3 continues to oscillate until the detected temperature reaches the cooking temperature. This determination is made by comparing the detected temperature CC with the cooking temperature CS(The 101 step).

In step 101, when the detected temperature CC detected from the sensor 5 is equal to or higher than the cooking temperature CS, the output controlling part 6E determines whether the detected temperature CC detected from the sensor 5 has reached the cooking temperature CS during the predetermined cooking time TS or not (step 103).

If the detected temperature CC is not greater than or equal to the cooking temperature CS, the output controlling part 6E reads a counted present time TC and compares the counted present time TC with the predetermined cooking time TS (The 113 step). In step 113, the output controlling part 6E determines that the real temperature of the food 7 reaches the cooking temperature when the value of the counted present time TC is greater than the value of the cooking time TS, at this time the cooking process is stopped (step 115).

That is, the finishing of the cooking requires that the heating operation of the heating part 3 and the rotation of turntable driving motor 8 stop.

However, when the output controlling part 6E determines, in step 113, the value of the counted present time TC is not greater than the value of the cooking time TS, it is recognized that there is a temperature errors, which is detected by the sensor, caused by electromagnetic wave noise. The output controlling part 6E temporarily stops the heating operation of the heating part 3 and substitutes the present time TC for a time variable TN. Also, a flag1 is set as a logical "1" in order to express that the detected temperature CC equals the cooking temperature CS within the cooking time TS (step 117).

Again, the operating process returns to step 101 and performs the 101 step and the 103 step repeatedly. In step 103, the controlling part 6E determines if the detected temperature CC ever obtained the cooking temperature CS within the cooking time TS according to the value (Flag=1) resulting from the 117 step.

Next, the output controlling part 6E determines whether the detected temperature CC caused by electromagnetic wave noise and detected from the sensor 5 reaches the cooking temperature CS (step 105).

At this time, a decision in the 105 step is made to stop the heating operation of the heating part 3 stops under the control of the output controlling part 6E. Therefore, the error of the detected temperature caused by the electromagnetic wave noise generated from heating part 3 is eliminated.

In this state, the output controlling part 6E is able to determine when the cooking temperature CS coincide with the real temperature of the food 7 detected from the sensor 5 during the rotation of the turntable 2.

To carry out the above decision operation, the output controlling part 6E continually counts the revolution time of the turntable 2 by means of a second timer 6G. At the same time, the output controlling part 6E continuously recognizes the value counted by the first timer 6F while the turntable 2 rotates.

That is, the output controlling part 6E determines that if the present time TC, which is counted by the first timer 6F is greater than the time (TN +1 second), which adds 1 second to the time variable TN gained step 117, and if it is within the value [TN+TT+1 second], which adds the revolution cycle TT of the turntable which is counted by the second timer 6G plus 1 second to the time variable TN (step 119).

After the present time TC counted by the first timer 6F exists within the range set in step 119, the temperature detected from the sensor 5 becomes the real temperature of the food 7. That is, the output controlling part 6E substitutes a higher value for a maximum temperature CMAX of the food 7, by continually comparing the present detected temperature with previous detected temperature (step 121 and step 123).

The present time TC is counted until a revolution of turntable 2 terminates in order to detect a maximum temperature CMAX of the food 7(step 125). Therefore, when the operation of step 125 ends, the present time TC becomes the value (TN+TT+1second) which adds the revolution cycle TT of the turntable 2 and 1 second to the time variable TN set in step 117.

Then, the output controlling part 6E determines whether the error of the temperature detection is caused by noise or the termination of normal cooking operation by comparing the maximum temperature CMAX of the food 7 with the cooking temperature CS.

To carry out the above decision operation, the output controlling part 6E allocates an error temperature CM to the cooking temperature CS in consideration of an error occurred during the cooking process. The error temperature is given as follows:

$$CM=(0.5\times CS-15) \text{ (step } \mathbf{127})$$

The error temperature can be set differently depending on MWO and the food for cooking.

The output controlling part 6E completes the cooking process by determining if the real temperature of the food 7 reaches the cooking temperature. This is determined when the maximum temperature CMAX of the food 7 gained from carrying out the steps up to step 125, is greater than the value (CS-CM), i.e. subtracting the error temperature CM from the cooking temperature CS (step 133).

In the case that the maximum temperature CMAX of the food 7 gained from carrying out the steps up to step 125 is smaller than the value (CS-CM), the output controlling part 6E determines if the present detected temperature reaches the cooking temperature due to the electromagnetic wave noise and corresponding sets Flag2 as a logical "1" (step 131). Again, the output controlling part 6E enables the process to return to the first step 101.

The output controlling part 6E performs step 103 if the detected temperature CC is greater than the cooking temperature CS in step 101 and performs step 105 if the detected temperature (the result gained after carrying out step 117) reaches the cooking temperature within the cooking time TS in step 103.

The output controlling part 6E recognizes that the detected temperature has reached the cooking temperature due to electromagnetic wave noise in step 105 (the result gained from carrying out the steps up to step 131) and re-operates the heating part 3. Regardless of temperature detected from the sensor 5, by adding the temperature (0.05×re-operation time TI of the heating part 3) gained in proportion to the heating time to reach the maximum temperature CMAX of food obtained in step 125 step, the output controlling part 6E calculates the detected temperature CC (step 107).

If the detected temperature in step 107 is greater than the cooking temperature (step 109), the output controlling part 6E recognizes that the food temperature reaches the cooking temperature, and stops the operation of the heating part 3(step 111).

As described above, the present invention compares the detected temperature CC of the food 7 detected from the sensor 5 during cooking with the cooking temperature CS, and stops the operation of the heating part 3 when the detected temperature reaches the cooking temperature, and measures the maximum temperature CMAX of the food 7 with the sensor 5, during one or more revolution cycle of the turntable 2 and determines to when the real temperature of food reaches the cooking temperature when the measured temperature is approximately the same as the cooking temperature.

If the real temperature of the food 7 does not reach an approximate value of the cooking temperature, the present invention determines that the detected temperature reaches the cooking temperature due to an electromagnetic wave noise and re-operates the heating part 3. Regardless of the temperature detected from the sensor 5, the present invention compares the re-calculated temperature, which adds the temperature (0.05×re-operation time TI of the heating part 3) gained in proportion to the heating time to the maximum temperature CMAX of the food 7, with the cooking temperatures and determines when the real temperature of the food 7 reaches the cooking temperature and stops the cooking process.

Figure 5:
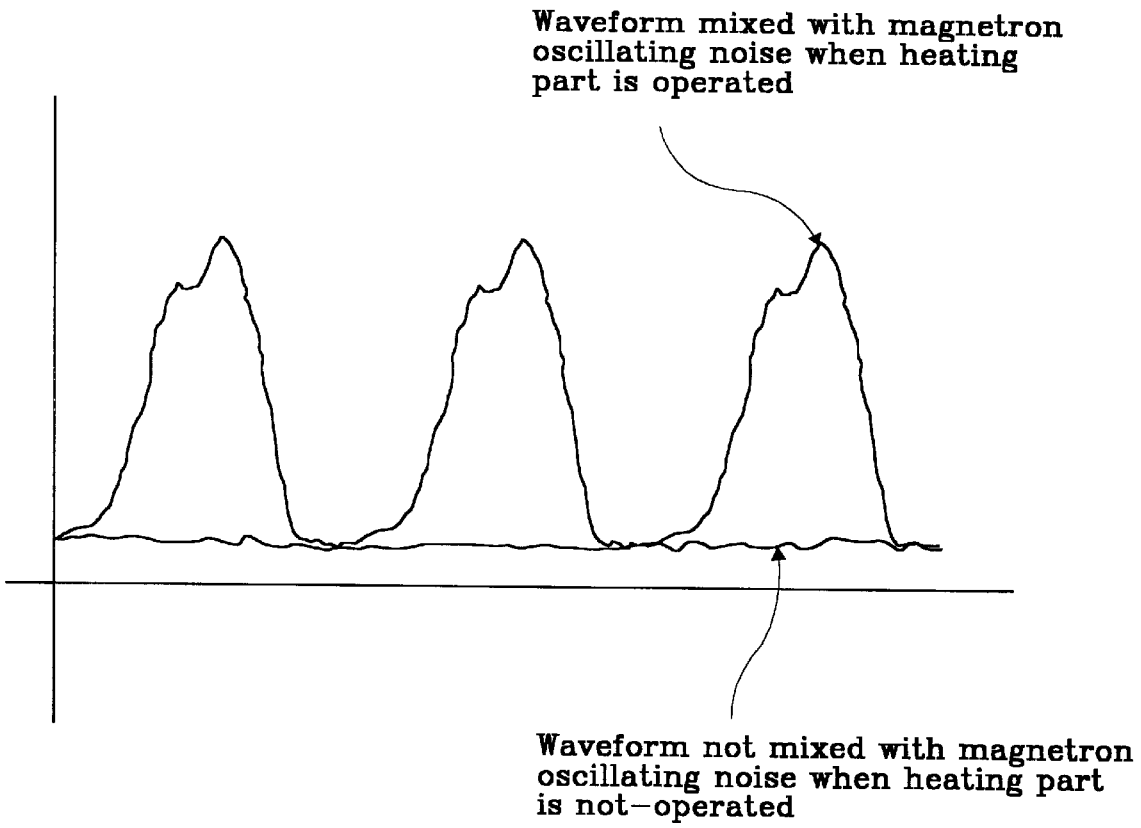
FIG. 5 illustrates a waveform mixed with oscillating noise of a magnetron according to the present invention.

As seen in FIG. 5, an oscillating noise of the magnetron influences a detected signal of the sensor 5; therefore, an erroneous temperature detection occurs when the heating part operates. On the other hand, if the heating part is shutdown, the sensor 5 is capable of operating correctly in determining the real temperature of the food 7.

Therefore, the present invention has the advantage of reducing the error temperature value caused by an electromagnetic wave noise which is likely to occur in cooking a small quantity of food especially.

The principles preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Others may make various changes without departing from the spirit of the present invention. Accordingly, it is expressly intended that all such variations and changes which fall within the spirit and scope of the present invention as defined in the claims be embraced thereby.

What is claimed is:

1. A method for compensating a cooking temperature in a microwave oven, the method comprising the steps of:

heating a food stuff in a microwave cavity;

comparing a temperature of said food stuff detected by an infrared sensor with a predetermined cooking temperature;

detecting another temperature of said food stuff during a non-heating operation of the microwave oven;

comparing said another temperature of said food stuff with said predetermined cooking temperature;

compensating for said another temperature of said food stuff by resuming a heating operation when said another temperature of said food stuff is lower than said predetermined cooking temperature; and recalculating said another temperature when it is determined said another temperature reaches said predetermined cooking temperature due to an electromagnetic wave noise.

2. The method of compensating a cooking temperature in a microwave oven according to claim 1, wherein said non-heating operation is preformed when an accumulated present cooking time is shorter than a preset time duration for reaching said predetermined cooking temperature.

3. The method of compensating a cooking temperature in a microwave oven according to claim 1, wherein the said detecting of said another temperature of said food stuff is performed during a rotational period of a turntable.

4. The method of compensating a cooking temperature in a microwave oven according to claim 3, further comprising the step of setting said another temperature to a maximum value of said temperature.

5. The method of compensating a cooking temperature in a microwave oven according to claim 1, wherein the step of recalculating includes the step of calculating said temperature of said food stuff as a sum of a maximum of said temperature and a product of a predetermined variable and a time of operation of a heating part.

6. The method of compensating a cooking temperature in a microwave oven according to claim 1, further including the step of determining if said temperature obtains a temperature level of said predetermined cooking temperature within a predetermined time.

7. The method of compensating a cooking temperature in a microwave oven according to claim 6, wherein the step of determining includes the step of rectifying if an accumulated present time is greater than said predetermined time, whereby if said accumulated present time is greater than said predetermined time, it is determined said another temperature has been reached and an operation of the microwave is terminated.

8. The method of compensating cooking temperature in a microwave oven according to claim 7, wherein the step of rectifying, if it is determined said accumulated present time is less than said predetermined time then an operation of a heating part is at least temporarily caused to turnoff.

* * * * *